US009454115B2

(12) United States Patent
Yotsutsuji et al.

(10) Patent No.: US 9,454,115 B2
(45) Date of Patent: Sep. 27, 2016

(54) FIXING DEVICE AND IMAGE FORMING APPARATUS

(71) Applicant: KYOCERA Document Solutions Inc., Osaka (JP)

(72) Inventors: Takefumi Yotsutsuji, Osaka (JP); Yoshiharu Kanematsu, Osaka (JP); Yoshihiro Yamagishi, Osaka (JP); Takashi Eiki, Osaka (JP); Eriko Hayashi, Osaka (JP); Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/718,889

(22) Filed: May 21, 2015

(65) Prior Publication Data

US 2015/0346661 A1 Dec. 3, 2015

(30) Foreign Application Priority Data

May 29, 2014 (JP) ..... 2014-110721

(51) Int. Cl.
*G03G 13/20* (2006.01)
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC combination set(s) only.
See application file for complete search history.

(56) References Cited

U.S. PATENT DOCUMENTS

2008/0124148 A1 5/2008 Kim et al.
2011/0058864 A1* 3/2011 Fujimoto ..... G03G 15/2007 399/329
2011/0164905 A1 7/2011 Kondo et al.
2013/0209125 A1 8/2013 Uchitani et al.
2014/0086651 A1 3/2014 Otsu
2015/0104230 A1 4/2015 Uchitani et al.

FOREIGN PATENT DOCUMENTS

EP 1927901 A1 6/2008
JP S59-061863 A 4/1984
JP 2013-164438 A 8/2013

OTHER PUBLICATIONS

The extended European search report issued by the European Patent Office on Oct. 26, 2015, which corresponds to European Patent Application No. 15168346.3-1560 and is related to U.S. Appl. No. 14/718,889.

* cited by examiner

*Primary Examiner* — Minh Phan
(74) *Attorney, Agent, or Firm* — Studebaker & Brackett PC

(57) ABSTRACT

A fixing device includes a fixing belt, a pressuring member, a heat source and a reflecting member. The fixing belt is arranged rotatably around a rotation axis. The reflecting member reflects the radiant heat radiated from the heat source. The fixing belt has a passing region and a non-passing region. Through the passing region, a recording medium passes. The non-passing region is arranged outside the passing region in a direction of the rotation axis. The reflecting member has a first reflecting part and a second reflecting part. The first reflecting part is arranged at an inner circumferential side of the passing region. The second reflecting part is arranged at an inner circumferential side of the non-passing region. Roughness of a face at the heat source side of the second reflecting part is larger than roughness of a face at the heat source side of the first reflecting part.

8 Claims, 7 Drawing Sheets

FIXING DEVICE AND IMAGE FORMING APPARATUS

INCORPORATION BY REFERENCE

This application is based on and claims the benefit of priority from Japanese patent application No. 2014-110721 filed on May 29, 2014, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine, a printer, a facsimile or a multifunction peripheral, includes a fixing device fixing a toner image onto a recording medium, such as a sheet.

For example, there is a fixing device including a fixing belt, a pressuring member configured to come into pressure contact with the fixing belt so as to form a fixing nip, a heat source arranged at an inner circumferential side of the fixing belt and a reflecting member configured to reflect the radiant heat radiated from the heat source.

In the fixing device with such a configuration, heat of a passing region (a region through which the recording medium passes) of the fixing belt is taken by the recording medium, while heat of a non-passing region (a region through which the recording medium does not pass) of the fixing belt is not taken by the recording medium. Accordingly, there is a concern that temperature of the non-passing region gets higher than that of the passing region and temperature distribution in a rotation axis direction of the fixing belt become uneven.

SUMMARY

In accordance with an embodiment of the present disclosure, a fixing device includes a fixing belt, a pressuring member, a heat source and a reflecting member. The fixing belt is arranged rotatably around a rotation axis. The pressuring member is arranged rotatably and configured to come into pressure contact with the fixing belt so as to form a fixing nip. The heat source is arranged at an inner circumferential side of the fixing belt and configured to radiate a radiant heat. The reflecting member is configured to reflect the radiant heat radiated from the heat source to an inner circumferential face of the fixing belt. The fixing belt has a passing region and a non-passing region. Through the passing region, a recording medium passes. The non-passing region is arranged outside the passing region in a direction of the rotation axis. The reflecting member has a first reflecting part and a second reflecting part. The first reflecting part is arranged at an inner circumferential side of the passing region. The second reflecting part is arranged outside the first reflecting part in the direction of the rotation axis and arranged at an inner circumferential side of the non-passing region. Roughness of a face at the heat source side of the second reflecting part is larger than roughness of a face at the heat source side of the first reflecting part.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
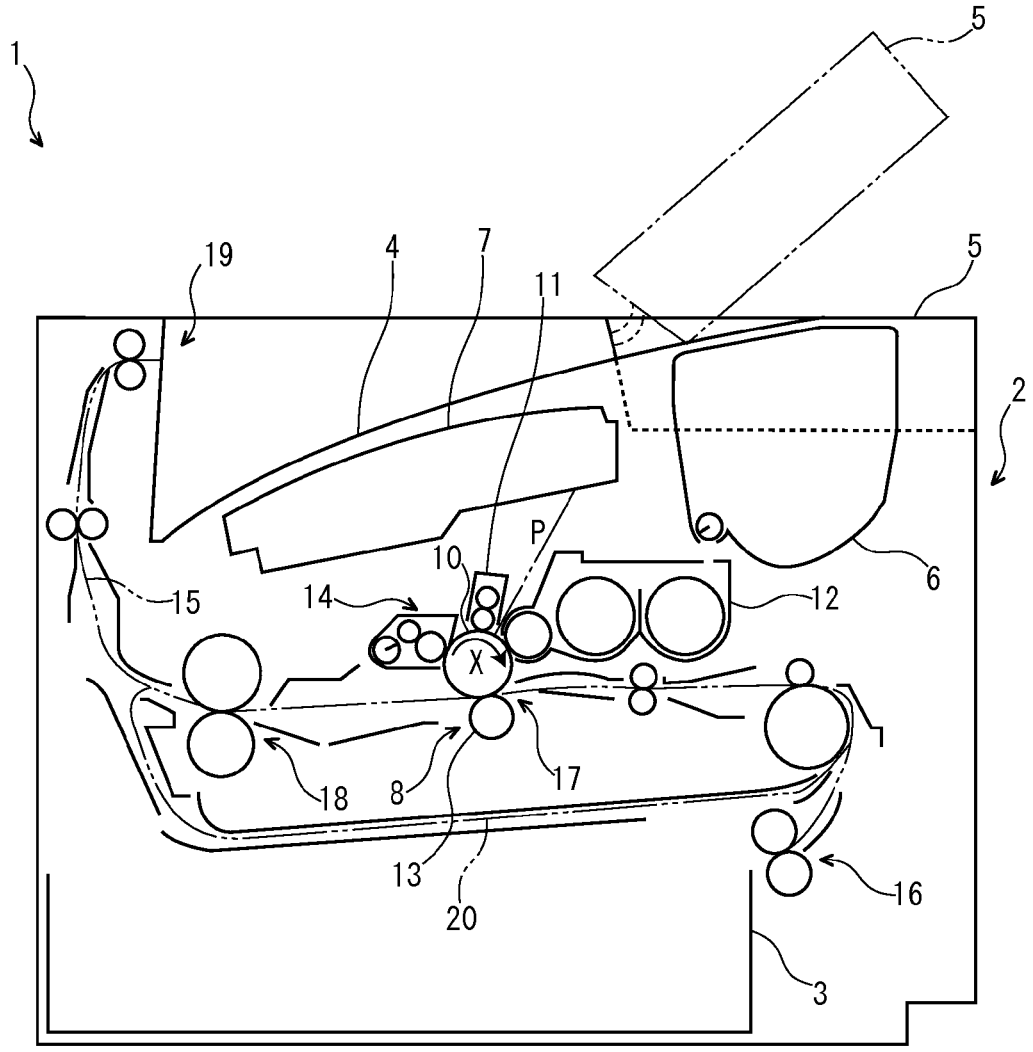
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is arranged below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are arranged along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, it will be described so that the front side of the fixing device 18 is positioned at the near side of FIG. 2, for convenience of explanation. Arrows Fr, Rr, L, R, U and Lo of each figure indicate a front side, a rear side, a left side, a right side, an upper side and a lower side of the fixing device 18, respectively. An arrow Y of each figure indicates a conveying direction of the sheet (in the embodiment, left and right directions).

Figure 2:
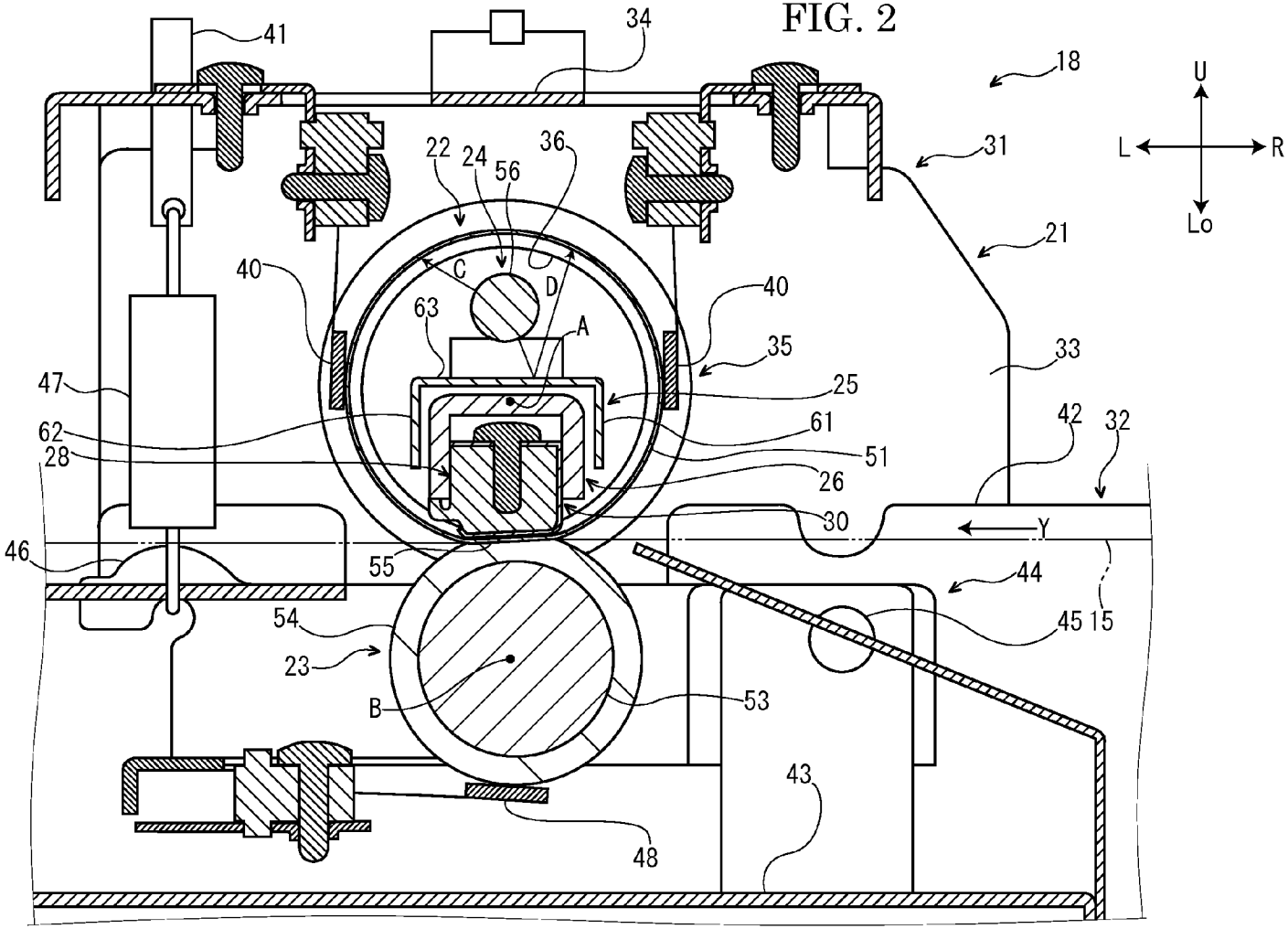
FIG. 2 is a sectional view showing a fixing device according to the embodiment of the present disclosure.

As shown in FIG. 2 and other figures, the fixing device 18 includes a box-like formed fixing frame 21, a fixing belt 22, a pressuring roller 23 (a pressuring member), a heater 24 (a heat source), a reflecting member 25, a supporting member 26, a pressing member 28 and a sheet member 30. The fixing belt 22 is installed in an upper part of the fixing frame 21. The pressuring roller 23 is installed in a lower part of the fixing frame 21. The heater 24 is arranged at an inner circumferential side of the fixing belt 22. The reflecting member 25 is arranged at the inner circumferential side of the fixing belt 22 and at a lower side of the heater 24. The supporting member 26 is arranged at the inner circumferential side of the fixing belt 22 and at a lower side of the reflecting member 25. The pressing member 28 is arranged at the inner circumferential side of the fixing belt 22 and at a lower side of the supporting member 26. The sheet member 30 is arranged between the fixing belt 22 and the pressing member 28.

The fixing frame 21 (refer to FIG. 2) is made of a plate metal. The fixing frame 21 is composed of an upper frame part 31 and a lower frame part 32 connected to each other.

The upper frame part 31 of the fixing frame 21 includes a pair of front and rear upper end plates 33 and a top plate 34 connecting upper end parts of the front and rear upper end plates 33. In FIG. 2, the front upper end plate 33 is omitted.

Figure 3:
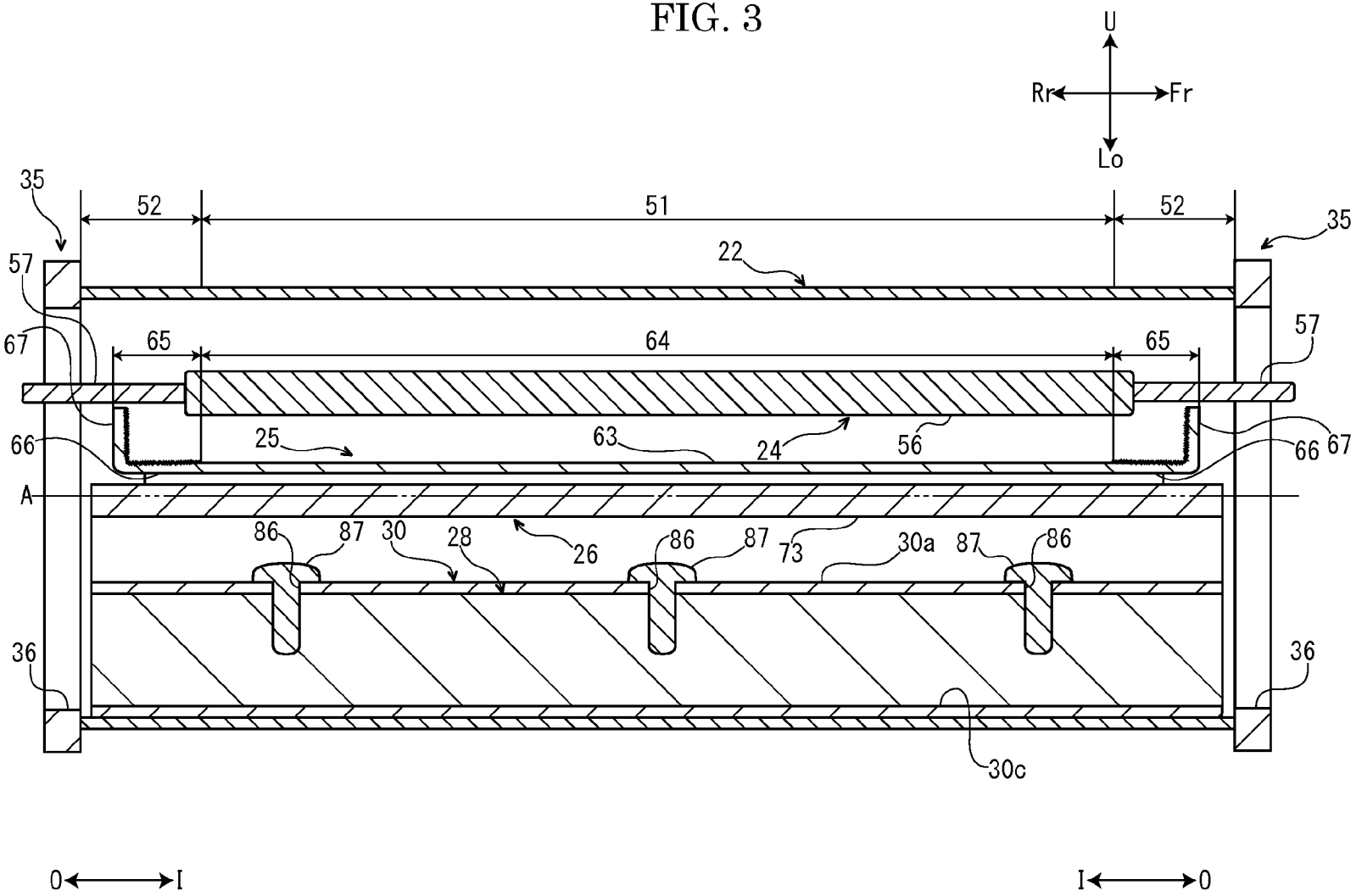
FIG. 3 is a sectional view showing a fixing belt and its peripheral, in the fixing device according to the embodiment of the present disclosure.

To an inner face of each upper end plate 33 of the upper frame part 31, a meandering restriction member 35 made of resin is fixed. As shown in FIG. 3, each meandering restriction member 35 is arranged outside the fixing belt 22 in a front and rear direction. Thereby, meandering (movement to one side in the front and rear direction) of the fixing belt 22 is restricted. Each meandering restriction member 35 has a through hole 36 formed in the front and rear direction.

As shown in FIG. 2, to both right and left side parts of the top plate 34 of the upper frame part 31, first thermistors 40 are fixed. Each first thermistor 40 comes into contact with an outer circumferential face of the fixing belt 22. To a left end part of the top plate 34, a pair of front and rear adjustment members 41 are attached in a movable state in an upper and lower direction. In FIG. 2, the front adjustment member 41 is omitted.

The lower frame part 32 of the fixing frame 21 includes a pair of front and rear lower end plates 42 and a bottom plate 43 connecting lower parts of the front and rear lower end plates 42. In FIG. 2, the front lower end plate 42 is omitted.

To an inside in the front and rear direction of the front and rear lower end plates 42 of the lower frame part 32, swing frames 44 are arranged. At a right end side of each swing frame 44, a fulcrum part 45 is arranged. At a left end side of each swing frame 44, an attachment piece 46 is arranged. The attachment piece 46 is connected to the adjustment member 41 of the upper frame part 31 via a coil spring 47 and the adjust member 41 moves in the upper and lower direction so that each swing frame 44 swings around the fulcrum part 45. To the lower frame part 32, a second thermistor 48 is fixed. The second thermistor 48 comes into contact with an outer circumferential face of the pressuring roller 23.

The fixing belt 22 (refer to FIGS. 2 and 3) is formed in a roughly cylindrical shape elongated in the front and rear direction. The fixing belt 22 has flexibility and is formed in an endless shape in a circumferential direction. The fixing belt 22 includes, for example, a base material layer, an elastic layer provided around the base material layer and a release layer covering the elastic layer. The base material layer of the fixing belt 22 is made of, for example, metal, such as steel special use stainless (SUS). Incidentally, the base material layer of the fixing belt 22 may be made of resin, such as polyimide (PI). The elastic layer of the fixing belt 22 is made of, for example, a silicone rubber. The release layer of the fixing belt 22 is made of, for example, perfluoro alkoxy alkane (PFA) tube. Each figure shows the respective layers (the base material layer, the elastic layer and the release layer) of the fixing belt 22 without distinguishing.

The fixing belt 22 is rotatable around a rotation axis A extending in the front and rear direction. That is, in the embodiment, a rotation axis direction of the fixing belt 22 is the front and rear direction. The fixing belt has a passing region 51 and non-passing regions 52 arranged at both front and rear side (outside in the front and rear direction) of the passing region 51. Through the passing region 51, a sheet of maximum size (for example, a sheet of A3 size) passes. Through the non-passing regions 52, the sheet of maximum size does not pass.

The pressuring roller 23 (refer to FIG. 2 and other figures) is formed in a roughly columnar shape elongated in the front and rear direction. The pressuring roller 23 is composed of, for example, a columnar core material 53, an elastic layer 54 provided around the core material 53 and a release layer (not shown) covering the elastic layer 54. The core material 53 of the pressuring roller 23 is made of, for example, metal, such as iron. The elastic layer 54 of the pressuring roller 23 is made of, for example, silicone rubber. The release layer (not shown) of the pressuring roller 23 is made of, for example, PFA tube.

The pressuring roller 23 is arranged at a lower side (an outer circumferential side) of the fixing belt 22. The pressuring roller 23 comes into pressure contact with the fixing belt 22 and, between the fixing belt 22 and the pressuring roller 23, a fixing nip 55 is formed. The pressuring roller 23 is rotatably supported by a center part in a longitudinal direction (in the embodiment, a center part in the left and right direction) of each swing frame 44 of the lower frame part 32. Each Swing frame 44 is swung around the fulcrum part 45 to move the pressuring roller 23 in the upper and lower direction so that the pressure of the fixing nip 55 is shifted.

The pressuring roller 23 is rotatable around a rotation axis B extending in the front and rear direction. That is, in the embodiment, a rotation axis direction of the pressuring roller 23 is the front and rear direction.

The heater 24 (refer to FIGS. 2 and 3 and other figures) is composed of, for example, a halogen heater. The heater 24 is arranged at the upper side of the reflecting member 25, the supporting member 26 and the pressing member 28. In other words, the heater 24 is arranged at the side further from the pressuring member 23 than the reflecting member 25, the supporting member 26 and the pressing member 28.

The heater 24 includes a heat radiating part 56 and an attachment part 57 arranged at both front and rear side (outside in the front and rear direction) of the heat radiating part 56. The heat radiating part 56 is configured to generate heat according to the operation of the heater 24 and to radiate a radiant heat.

The reflecting member 25 (refer to FIGS. 2-5) is formed in a shape elongated in the front and rear direction. The reflecting member 25 is made of a metal, such as an aluminum alloy for brightening, for example. The reflecting member 25 is arranged between the heater 24 and the supporting member 26.

Figure 4:
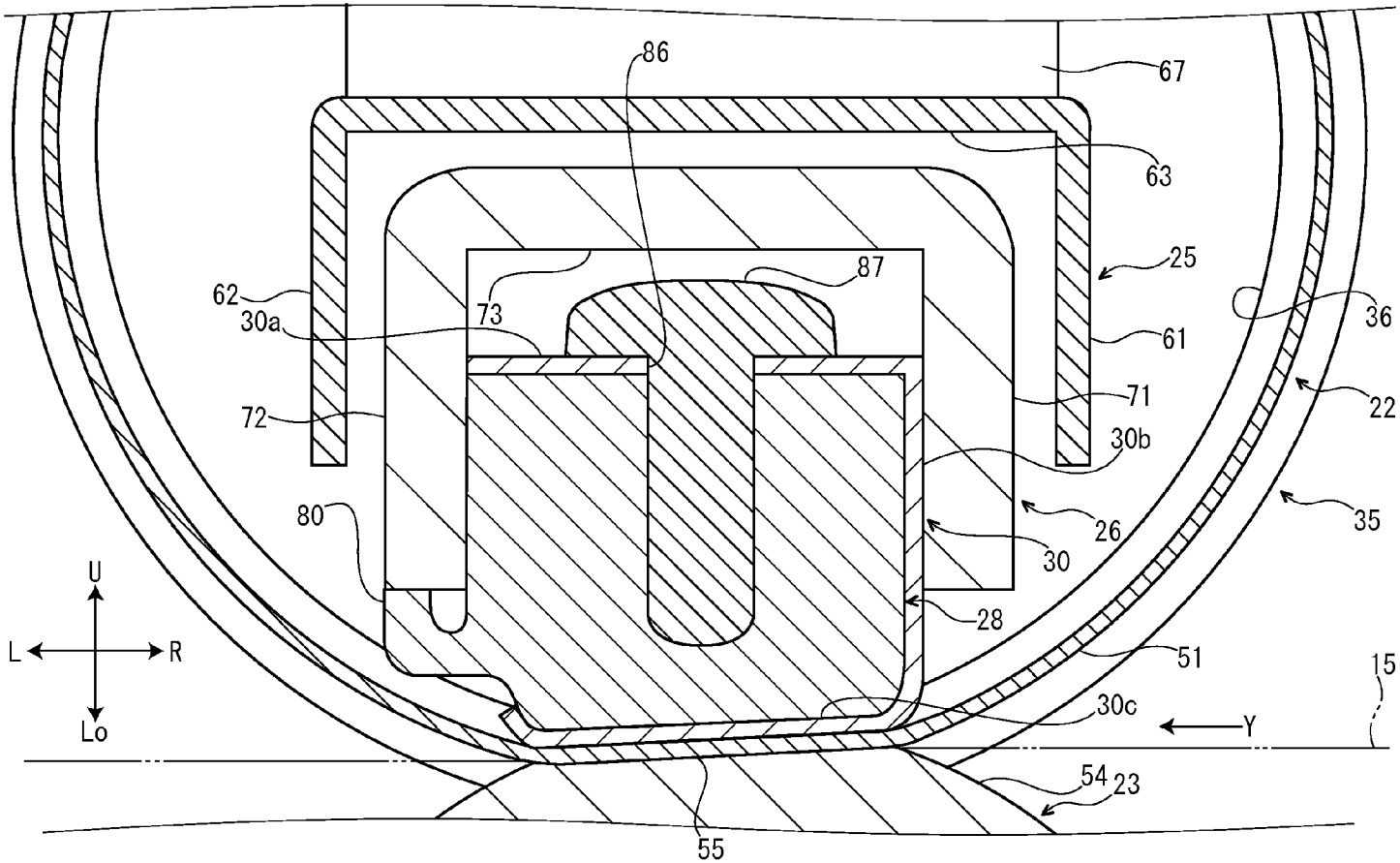
FIG. 4 is a sectional view showing a lower part of the fixing belt and its peripheral, in the fixing device according to the embodiment of the present disclosure.

As shown in FIG. 4 and other figures, the reflecting member 25 includes a first plate part 61 and a second plate part 62 which are provided along the upper and lower direction, and a third plate part 63 which is provided along the left and right direction and connects upper end parts of the first plate part 61 and the second plate part 62.

The first plate part 61 of the reflecting member 25 is arranged at a right side (an upstream side in the sheet conveying direction) of the supporting member 26. The second plate part 62 of the reflecting member 25 is arranged at a left side (a downstream side in the sheet conveying direction) of the supporting member 26.

Figure 5:
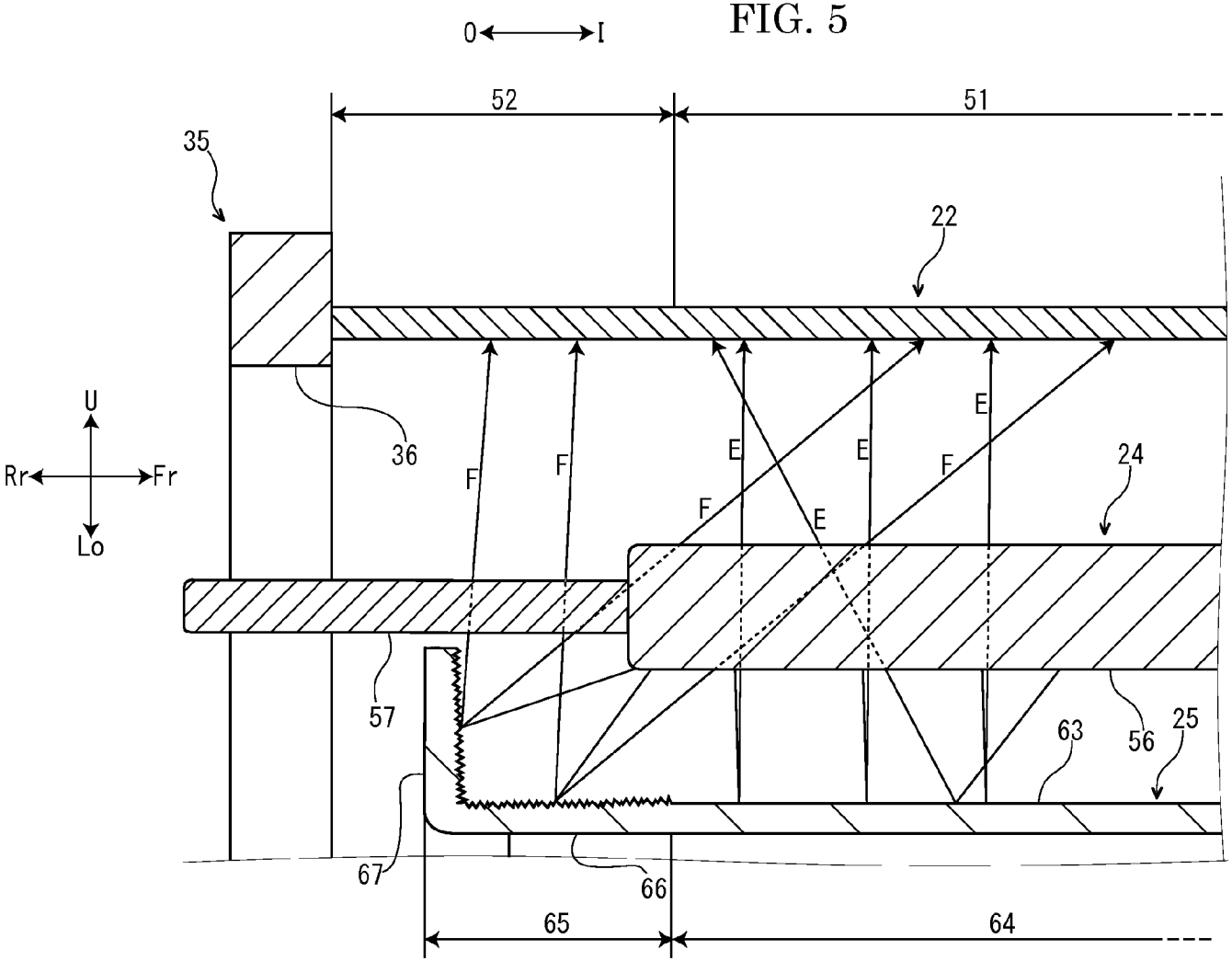
FIG. 5 is a sectional view showing a rear end part of a reflecting member and its peripheral, in the fixing device according to the embodiment of the present disclosure.

As shown in FIGS. 3 and 5, the third plate part 63 of the reflecting member 25 has a first reflecting part 64 and second reflecting parts 65 arranged at both front and rear sides (outside in the front and rear direction) of the first reflecting part 64.

The first reflecting part 64 is arranged at an inner circumferential side of the passing region 51 of the fixing belt 22. The first reflecting part 64 is elongated along the front and rear direction. An upper face (the heater 24 side face) of the first reflecting part 64 is subjected to a mirror surface treatment. Ten-point average roughness RZ of the upper face of the first reflecting part 64 is 0.5 μm to 1 μm, for example.

Each second reflecting part 65 is arranged at an inner circumferential side of each non-passing region 52 of the fixing belt 22. Each second reflecting part 65 has a base part 66 elongated along the front and rear direction and a folded part 67 orthogonally folded to an upper side (the heater 24 side) from an outside end part in the front and rear direction of the base part 66. An upper face (the heater 24 side face) of the base part 66 and the inside face in the front and rear direction (the heater 24 side face) of the folded part 67 are subjected to a rough surface treatment. Ten-point average roughness Rz of the upper face of the base part 66 and the inside face in the front and rear direction of the folded part 67 are 5 μm to 10 μm, for example, and are larger than the ten-point average roughness Rz of the upper face of the first reflecting part 64. The ten-point average roughness Rz of the upper face of the base part 66 and the ten-point average roughness Rz of the inside face in the front and rear direction of the folded part 67 are the same. The folded part 67 of each second reflecting part 65 is arranged between the heat radiating part 56 of the heater 24 and each meandering restriction member 35.

The supporting member 26 (refer to FIG. 4 and other figures) is formed in a shape elongated in the front and rear direction. The supporting member 26 is made of a sheet metal, such as an SECC (zinc-coated steel sheet). The supporting member 26 is formed in a U shape which is convex upward.

The supporting member 26 has a first supporting part 71 and a second supporting part 72 which are provided along the upper and lower direction (a direction orthogonal to the sheet conveying direction), and a third supporting part 73 which is provided along the left and right direction and connects upper end parts (end parts at a far side from the fixing nip 55) of the first supporting part 71 and the second supporting part 72. The upper side parts of the first supporting part 71 and the second supporting part 72 and the third supporting part 73 are inserted into a space formed between the first plate part 61 and the second plate part 62 of the reflecting member 25. The supporting member 26 does not come into contact with the reflecting member 25.

The pressing member 28 (refer to FIGS. 3 and 4 and other figures) is formed in a shape elongated in the front and rear direction. The pressing member 28 is made of heat resistant resin, such as LCP (liquid crystal polymer), for example. The pressing member 28 is supported from an upper side by the supporting member 26.

At a lower end part of a left face (a downstream side face in the sheet conveying direction) of the pressing member 28, a protruding piece 80 is protruded. The protruding piece 80 comes into contact with a lower end part (end part at the fixing nip 55 side) of the second supporting part 72 of the supporting member 26. The upper side part of the pressing member 28 is inserted into a space formed between the first supporting part 71 and the second supporting part 72 of the supporting member 26.

A lower face (the fixing nip 55 side face) of the pressing member 28 is inclined toward a lower side (the pressuring roller 23 side) from a right side (an upstream side in the sheet conveying direction) to a left side (the downstream side in the sheet conveying direction). The lower face of the pressing member 28 presses the fixing belt 22 toward a lower side (the pressuring roller 23 side).

Figure 6:
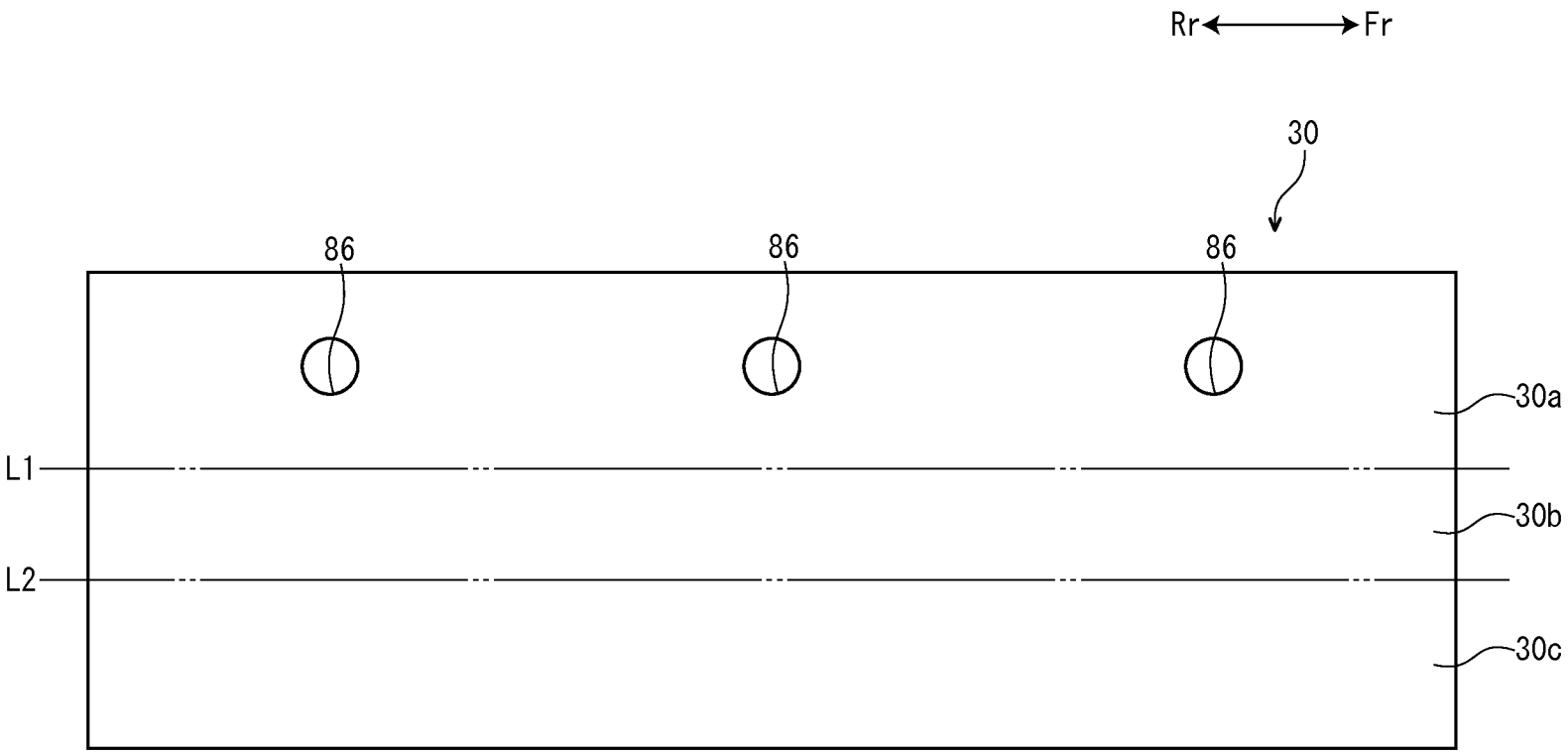
FIG. 6 is a plan view showing a sheet member in a developed state, in the fixing device according to the embodiment of the present disclosure.

The sheet member 30 (refer to FIGS. 3, 4 and 6 and other figures) is made of a fluororesin, such as a PTFE, for example, and has a lower friction coefficient than that of the pressing member 28. The sheet member 30 is formed in a shape elongated in the front and rear direction. In addition, a two-dot chain line L1 in FIG. 6 indicates a boundary between a width direction one side part 30*a* and a width direction center part 30*b* of the sheet member 30, and a two-dot chain line L2 in FIG. 6 indicates a boundary between a width direction center part 30*b* and a width direction other side part 30*c* of the sheet member 30.

At the width direction one side part 30*a* of the sheet member 30, a plurality of attachment holes 86 are formed at intervals in the front and rear direction. The width direction one side part 30*a* of the sheet member 30 is fixed to the upper face (a face at a far side from the fixing nip 55) of the pressing member 28 by a screw 87 penetrating each attachment hole 86. The width direction center part 30*b* of the sheet member 30 is sandwiched between the first supporting part 71 of the supporting member 26 and a right face (an upstream side face in the sheet conveying direction) of the pressing member 28. The width direction other side part 30*c* of the sheet member 30 is sandwiched between the lower face (fixing nip 55 side face) of the pressing member 28 and the inner circumferential face of the fixing belt 22.

In the fixing device 18 configured as described above, in order to fix the toner image onto the sheet, a drive source (not shown) rotates the pressuring roller 23. When the pressuring roller 23 is thus rotated, the fixing belt 22 coming into pressure contact with the pressuring roller 23 is co-rotated in an opposite direction to the pressuring roller 23. When the fixing belt 22 is thus rotated, the fixing belt 22 slides with respect to the sheet member 30.

In addition, in order to fix the toner image onto the sheet, the heater 24 is operated. When the heater 24 thus operated, the heat radiating part 56 of the heater 24 radiates the radiant heat. A part of the radiant heat radiated from the heat radiating part 56 of the heater 24 reaches directly the inner circumferential face of the fixing belt 22 as indicated by an arrow C in FIG. 2 and absorbed by the inner circumferential face of the fixing belt 22. Another part of the radiant heat radiated from the heat radiating part 56 of the heater 24 is reflected by the upper face of the third plate part 63 of the reflecting member 25 toward the inner circumferential face of the fixing belt 22 as indicated by an arrow D in FIG. 2, and then, is absorbed by the inner circumferential face of the fixing belt 22.

According to action as mentioned above, the fixing belt 22 is heated by the heater 24. In such a situation, when the sheet passes through the fixing nip 55, the toner image is heated and molten, thereby fixing the toner image onto the sheet.

In the present embodiment, the ten-point average roughness Rz of the upper face (the heater 24 side face) of the base part 66 of the second reflecting part 65 and the inside face in the front and rear direction (the heater 24 side face) of the folded part 67 of the second reflecting part 65 are larger than the ten-point average roughness Rz of the upper face (the heater 24 side face) of the first reflecting part 64. An effect obtained by applying this configuration will be described with reference to FIG. 5.

First, the upper face of the first reflecting part 64 has the smaller ten-point average roughness Rz and a higher reflectance than the upper face of the base part 66 of the second reflecting part 65 and the inside face in the front and rear direction of the folded part 67 of the second reflecting part 65. Hence, most of the radiant heat radiated from the heat radiating part 56 of the heater 24 to the upper face of the first reflecting part 64 are regularly reflected to the passing region 51 of the fixing belt 22 as indicated by arrows E in FIG. 5. According to this, the passing region 51 of the fixing belt 22 is efficiently heated.

Meanwhile, the upper face of the base part 66 of the second reflecting part 65 and the inside face in the front and rear direction of the folded part 67 of the second reflecting part 65 have larger ten-point average roughness Rz and lower reflectance than the upper face of the first reflecting part 64. Hence, most of the radiant heat radiated from the heat radiating part 56 of the heater 24 to the upper face of the base part 66 of the second reflecting part 65 and the inside face in the front and rear direction of the folded part 67 of the second reflecting part 65 is irregularly reflected to the passing region 51 and the non-passing regions 52 of the fixing belt 22 as indicated by arrows F in FIG. 5.

As described above, in the present embodiment, it is possible to, while concentrating the radiant heat reflected by the upper face of the first reflecting part on the passing region 51 of the fixing belt 22, disperse the radiant heat reflected by the upper face of the base part 66 of the second reflecting part 65 and the inside face in the front and rear direction of the folded part 67 of the second reflecting part 65 to the passing region 51 and the non-passing regions 52 of the fixing belt 22. Consequently, it is possible to prevent the temperature of the non-passing regions 52 of the fixing belt 22 from getting higher than the temperature of the passing region 51 of the fixing belt 22, and prevent the temperature distribution of the fixing belt 22 in the front and rear direction from becoming uneven.

Further, in the present embodiment, as described above, the folded part 67 of the second reflecting part 65 is folded to the upper side (the heater 24 side), and the folded part 67 is arranged between the heat radiating part 56 of the heater 24 and each meandering restriction member 35. By applying this configuration, it is possible to prevent the radiant heat radiated from the heat radiating part 56 of the heater 24 from being directly radiated on each meandering restriction part 35, and prevent the temperature of each meandering restriction member 35 from rising.

Meanwhile, when the folded part 67 is folded to the upper side as described above, there is a concern that the radiant heat reflected by the inside face in the front and rear direction of the folded part 67 concentrates on the non-passing regions 52 of the fixing belt 22, and therefore the temperature of the non-passing regions 52 of the fixing belt 22 excessively rise. However, in the present embodiment, the ten-point average roughness Rz of the inside face in the front and rear direction of the folded part 67 is larger than the ten-point average roughness Rz of the upper face of the first reflecting part 64 so as to disperse the radiant heat reflected by the inside face in the front and rear direction of the folded part 67 to the passing region 51 and the non-passing regions 52 of the fixing belt 22. Consequently, it is possible to prevent the radiant heat reflected by the inside face in the front and rear direction of the folded part 67 from concentrating on the non-passing regions 52 of the fixing belt 22, and prevent the temperatures of the non-passing regions 52 of the fixing belt 22 from excessively rising.

Further, the upper face of the base part 66 of the second reflecting part 65 and the inside face in the front and rear direction of the folded part 67 of the second reflecting part 65 are subjected to a rough surface treatment. By applying this configuration, it is possible to increase the ten-point average roughness Rz of the upper face of the base part 66 of the second reflecting part 65 and the inside face in the front and rear direction of the folded part 67 of the second reflecting part 65 by a simple configuration.

Further, the upper face of the first reflecting part 64 is subjected to a mirror surface treatment. By applying this configuration, it is possible to decrease the ten-point average roughness Rz of the upper face of the first reflecting part 64 by a simple configuration.

In the present embodiment, the upper face of the base part 66 of the second reflecting part 65 and the inside face in the front and rear direction of the folded part 67 of the second reflecting part 65 are subjected to the rough surface treatment, and the upper face of the first reflecting part 64 is subjected to the mirror surface treatment. By applying this configuration, it is possible to makes the ten-point average roughness Rz of the upper face of the base part 66 of the second reflecting part 65 and the inside face in the front and rear direction of the folded part 67 of the second reflecting part 65 sufficiently larger than the ten-point average roughness Rz of the upper face of the first reflecting part 64.

Further, in the present embodiment, the upper face of the first reflecting part 64 is subjected to the mirror surface treatment, and the upper face of the base part 66 of the second reflecting part 65 and the inside face in the front and rear direction of the folded part 67 of the second reflecting part 65 are subjected to the rough surface treatment, so that it is possible to prevent the temperature distribution of the fixing belt 22 in the front and rear direction from becoming uneven. By applying this configuration, it is possible to simplify a configuration of the reflecting member 25 and prevent cost from rising compared to a configuration that the temperature distribution of the fixing belt 22 in the front and rear direction is prevented from becoming uneven by changing materials of the first reflecting part 64 and the second reflecting part 65.

Further, in the present embodiment, the lower face of the pressing member 28 presses the fixing belt 22 to the lower side (the pressuring roller 23 side). By applying this configuration, it is possible to reduce a heat capacity of the fixing device 18.

In the present embodiment, a case where the ten-point average roughness Rz of the upper face of the base part 66 and the ten-point average roughness Rz of the inside face in the front and rear direction of the folded part 67 are the same has been described. Meanwhile, in another embodiment, the ten-point average roughness Rz of the inside face in the front and rear direction of the folded part 67 may be larger than the ten-point average roughness Rz of the upper face of the base part 66. By applying this configuration, it is possible to more effectively prevent the radiant heat from concentrating on the non-passing regions 52 of the fixing belt 22.

Figure 7:
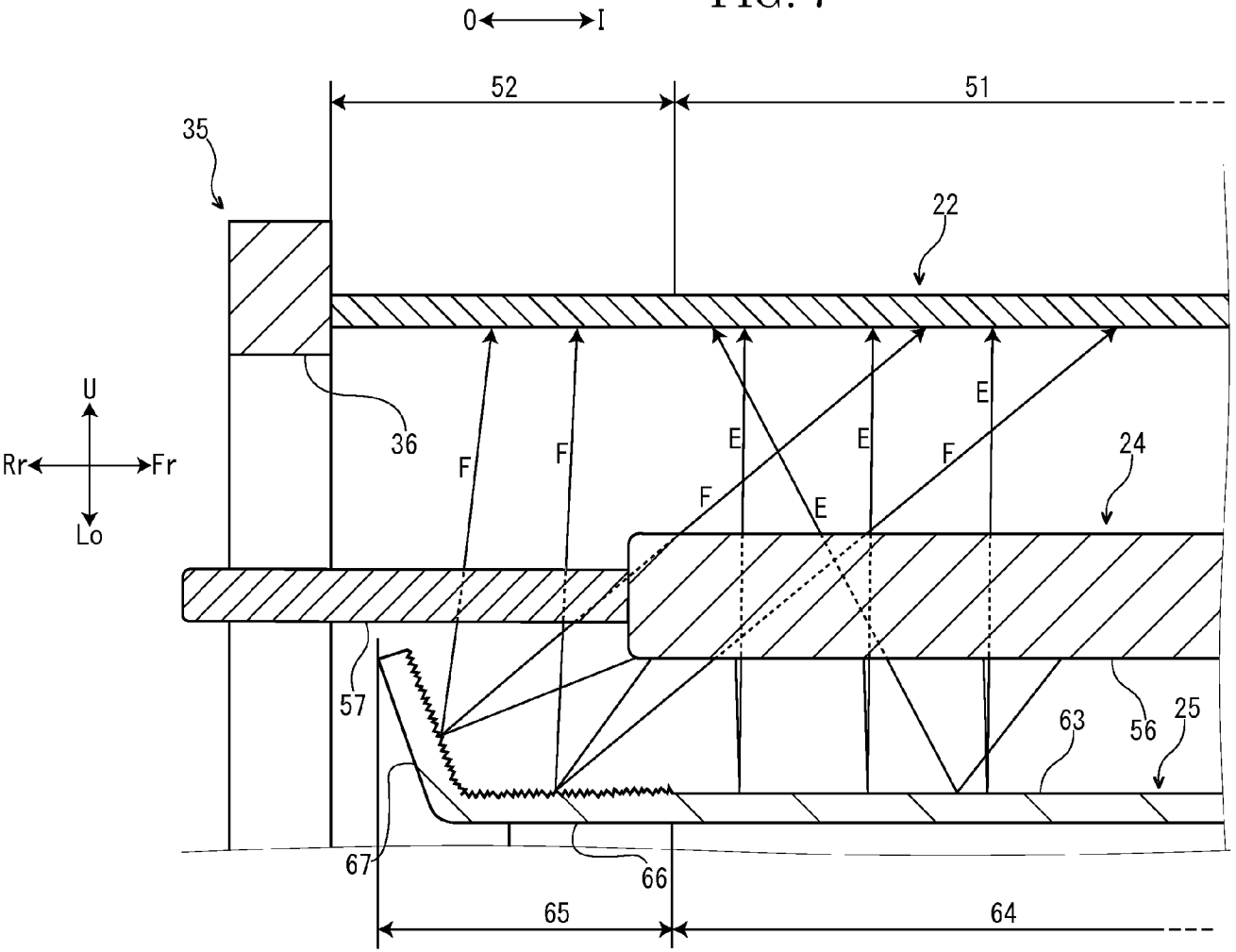
FIG. 7 is a sectional view showing a rear end part of a reflecting member and its peripheral, in a fixing device according to another embodiment of the present disclosure.

In the present embodiment, a case where the folded part 67 is orthogonally folded to an upper side (the heater 24 side) from the outside end part in the front and rear direction of the base part 66 has been described. Meanwhile, in another embodiment, as shown in FIG. 7, the folded part 67 may be inclined to the upper side (the heater 24 side) toward the outside in the front and rear direction as long as the radiant heat reflected by the folded part 67 does not leak to the outside in the front and rear direction of the fixing belt 22.

In the present embodiment, a case where a part (folded part 67) of the second reflecting part 65 of the reflecting member 25 is folded to the upper side (the heater 24 side) has been described. Meanwhile, in another embodiment, a whole part of the second reflecting part 65 of the reflecting member 25 may be folded to the upper side (the heater 24 side).

In the present embodiment, a case where the reflecting member 25 has the first plate part 61, the second plate part 62 and the third plate part 63 has been described. Meanwhile, in another embodiment, the reflecting member 25 may have only a part corresponding to the third plate part 63.

In the present embodiment, a case where the sheet member 30 is arranged between the fixing belt 22 and the pressing member 28 has been described. In another embodiment, the sheet member 30 may not be arranged between the fixing belt 22 and the pressing member 28, and the fixing belt 22 and the pressing member 28 may come into contact with each other.

In the present embodiment, a case of using the halogen heater as the heater 24 has been described. In another embodiment, a ceramic heater or the like may be used as the heater 24.

The embodiment was described in a case of applying the configuration of the present disclosure to the printer 1. In another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably around a rotation axis;

a pressuring member arranged rotatably and configured to come into pressure contact with the fixing belt so as to form a fixing nip;

a pressing member configured to press the fixing belt to the pressuring member side;

a supporting member configured to support the pressing member;

a heat source arranged at an inner circumferential side of the fixing belt and configured to radiate a radiant heat; and a reflecting member configured to reflect the radiant heat radiated from the heat source to an inner circumferential face of the fixing belt;

wherein the fixing belt has:

a passing region through which a recording medium passes; and a non-passing region arranged outside the passing region in a direction of the rotation axis, wherein the reflecting member includes:

a first plate part arranged at an upstream side of the supporting member in a conveying direction of the recording medium;

a second plate part arranged at a downstream side of the supporting member in the conveying direction of the recording medium; and a third plate part configured to connect an end part at a far side from the fixing nip of the first plate part and an end part at the far side from the fixing nip of the second plate part, wherein a part of the pressing member is inserted into a space formed between the first plate part and the second plate part, wherein the third plate part has:

a first reflecting part arranged at an inner circumferential side of the passing region; and a second reflecting part arranged outside the first reflecting part in the direction of the rotation axis and arranged at an inner circumferential side of the non-passing region, roughness of a face at the heat source side of the second reflecting part is larger than roughness of a face at the heat source side of the first reflecting part.

2. The fixing device according to claim 1, wherein at least a part of the second reflecting part is folded to the heat source side.

3. The fixing device according to claim 1, wherein the face at the heat source side of the second reflecting part is subjected to a rough surface treatment.

4. The fixing device according to claim 1, wherein the face at the heat source side of the first reflecting part is subjected to a mirror surface treatment.

5. The fixing device according to claim 1, further comprising a meandering restriction member arranged outside the fixing belt in the direction of the rotation axis, wherein at least a part of the second reflecting part is arranged between the heat source and the meandering restriction member.

6. The fixing device according to claim 1, wherein the supporting member includes:

a first supporting part and a second supporting part arranged along a direction orthogonal to the conveying direction of the recording medium; and a third supporting part connecting an end part at the far side from the fixing nip of the first supporting part and an end part at the far side from the fixing nip of the second supporting part, the part of the pressing member is inserted into a space formed between the first supporting part and the second supporting part.

7. The fixing device according to claim 6, wherein a protruding piece is arranged at a downstream side face of the pressing member in the conveying direction of the recording medium, the protruding piece configured to come into contact with an end part at the fixing nip side of the second supporting part.

8. An image forming apparatus comprising the fixing device according to claim 1.

* * * * *